United States Patent [19]

Wagstaff

[11] Patent Number: 4,693,298

[45] Date of Patent: Sep. 15, 1987

[54] MEANS AND TECHNIQUE FOR CASTING METALS AT A CONTROLLED DIRECT COOLING RATE

[75] Inventor: Frank E. Wagstaff, Spokane, Wash.

[73] Assignee: Wagstaff Engineering, Inc., Seattle, Wash.

[21] Appl. No.: 939,325

[22] Filed: Dec. 8, 1986

[51] Int. Cl.[4] ..... B22D 11/124

[52] U.S. Cl. ..... 164/486; 164/444

[58] Field of Search ..... 164/443, 444, 485, 486, 164/487

[56] References Cited

U.S. PATENT DOCUMENTS

| | | | |
|---|---|---|---|
| 3,713,479 | 1/1973 | Bryson | 164/444 |
| 4,157,728 | 6/1979 | Mitamura et al. | 164/487 |
| 4,166,495 | 9/1979 | Yu | 164/486 |
| 4,597,432 | 7/1986 | Collins et al. | 164/444 |
| 4,598,763 | 7/1986 | Wagstaff et al. | 164/444 |

OTHER PUBLICATIONS

Yu, Ho, "A Process to Reduce DC Ingot Butt Curl and Swell", *Journal of Metals, Nov., 1980, pp. 23-27.*

*Primary Examiner*—Nicholas P. Godici
*Assistant Examiner*—Richard K. Seidel
*Attorney, Agent, or Firm*—Christopher Duffy

[57] ABSTRACT

Close control of the direct cooling rate is achieved by bubbling a substantially insoluble gas into the curtain-forming coolant as it is about to discharge onto the emerging ingot. The resulting bubble-entrained curtain of coolant experiences an increased velocity, and the increase is not accompanied by a reduction in the thermal conductivity of the coolant. Instead, the bubble-entrained coolant appears to have a scrubbing effect on the metal, which breaks up any film and reduces the tendency for film boiling to occur at the surface of the metal, thus allowing the process to operate at the more desirable level of nucleate boiling, if desired. This in turn makes it possible to regulate the cooling rate by selective use of the bubbling effect, including turning the effect on and off to allow film boiling to occur when desired, such as in the butt forming stage of the casting operation. The bubbling effect can also be used to regulate the cooling rate when the coolant is in short supply and/or hotter than desired.

40 Claims, 11 Drawing Figures

MEANS AND TECHNIQUE FOR CASTING METALS AT A CONTROLLED DIRECT COOLING RATE

TECHNICAL FIELD

This invention relates to the continuous (including semicontinuous) casting of metals such as aluminum by direct cooling, and in particular, to a means and technique for controlling the rate at which the metal is direct cooled in the casting operation.

BACKGROUND ART

Metals are commonly cast as ingot by pouring molten metal into one end opening of an open ended mold while the resulting body of partially solidified metal or "ingot" is advanced from the opposing end of the mold on a stool or support which is reciprocated in relation to the mold. To cast successfully, however, the operator must closely control the temperature of the metal, and this is accomplished by cooling the mold itself, and directing liquid coolant against the surface of the metal ingot as it emerges from the mold. The rate at which heat is extracted from the metal by the latter operation is a function of the temperature of the coolant itself, and the velocity of the coolant flow. For any given piece of molding equipment, moreover, the velocity is largely a function of the rate at which the coolant is discharged onto the ingot.

Initially, both the metal and the equipment are relatively cold, and therefore, the support is reciprocated from the mold at a relatively low rate of withdrawal or "casting speed." The coolant is likewise discharged at a relatively low rate, and every other attempt is made to maintain a low rate of heat extraction from the ingot while the butt end of the same is being formed on the support. However, after the butt end has emerged from the mold, the casting speed is increased, and for the remainder of the casting operation, the coolant is discharged onto the ingot at a sharply increased rate. This latter stage is commonly called the "steady state" casting stage. The initial low speed casting stage is commonly called the "butt forming" stage.

Unfortunately, plant operators have not been able to control the parameters of coolant temperature and velocity to the extent they would like. The coolant is commonly the water supplied to the operator's plant from local sources, and not only does the supply fluctuate as to available volume, but it fluctuates dramatically in temperature from one season to another, such as from summer to winter and vice versa. Furthermore, there is a minimum flow rate which the operator must maintain if he is to avoid a point where so called "film boiling" occurs. This is the point at which the surface of the ingot is no longer continuously wetted by the coolant, but instead is enveloped in a film of steam which limits heat loss from the metal to the factors of conduction and radiation alone. Often, when the local water is too hot and/or in short supply, operators have had to import additional water to lower the temperature of the coolant and maintain a cooling rate above that at which film boiling would occur.

The patentee in U.S. Pat. No. 4,166,495 sought to control the rate of heat removal during the initial low speed butt forming stage of his operation by dissolving a gas in the coolant. The addition of the gas was said to retard the rate at which heat was extracted from the metal during this initial stage. Later, when the steady state casting stage was begun, the gas was no longer dissolved in the coolant, and the operation was conducted thereafter with the coolant alone.

DISCLOSURE OF THE INVENTION

As in U.S. Pat. No. 4,166,495, a gas is also added to the coolant of the present invention to control the rate at which heat is extracted from the metal of the emerging ingot. However, the gas is not dissolved in the coolant, but instead is infused or entrained in the coolant as tiny, discrete, undissolved bubbles of the same which accompany the coolant flow as it is directed onto the surface of the emerging ingot. Moreover, rather than the amended coolant operating to cool the metal at a reduced rate of heat extraction, the bubble-entrained coolant operates to cool the metal at an increased rate of heat extraction; and if the operator desires, he can use the increased rate of extraction, together with the discharge rate of the coolant, to control the rate of cooling at any stage in the casting operation, including during the steady state casting stage.

Furthermore, if the operator desires, he can use the increased rate of extraction to offset the lack of control that he has over temperature and discharge rate, since if the temperature and/or availability of the coolant supply require it, he can allow cooling to occur in the film boiling range and use the present invention to regulate it, such as during the initial butt forming stage, when a low cooling rate is desirable, as explained earlier. In fact if he desires, he can make selective use of the increased rate of extraction to control the cooling rate throughout the casting operation, for both stages thereof. That is, he can activate or deactivate the effect at will, for example, to allow film boiling to occur when desired, and to terminate it or offset it when desired.

According to the invention, molten metal is introduced to the cavity of an annular mold, through one end opening thereof, and while the metal undergoes partial solidification in the mold to form a body of the same on a support adjacent the other end opening of the cavity, the mold and support are reciprocated in relation to one another endwise of the cavity to elongate the body of metal through the latter opening of the cavity. In addition, liquid coolant is introduced to an annular flow passage which is circumposed about the cavity in the body of the mold and opens into the ambient atmosphere of the mold adjacent the aforesaid opposite end opening thereof to discharge the coolant as a curtain of the same that impinges on the emerging body of metal for direct cooling of the same. Meanwhile, a gas which is substantially insoluble in the coolant liquid, is charged under pressure into an annular distribution chamber which is disposed about the passage in the body of the mold and opens into the passage through an annular slot disposed upstream from the discharge opening of the passage at the periphery of the coolant flow therein. The body of gas in the chamber is released into the passage through the slot, and is subdivided into a multiplicity of gas jets as the gas discharges through the slot. The jets are released into the coolant flow at a temperature and pressure at which the gas is entrained in the flow as a mass of bubbles that tend to remain discrete and undissolved in the coolant as the curtain of the same discharges through the opening of the passage and impinges on the emerging body of metal. With the mass of bubbles entrained therein, the curtain has an increased velocity, and this increase can be used to regulate the cooling rate of the coolant liquid, since it more than offsets any reduction in the thermal conductivity of the coolant. In fact, the high velocity bubble-entrained curtain of coolant appears to have a scrubbing effect on the metal, which breaks up any film and reduces the tendency for film boiling to occur at the surface of the metal, thus allowing the process to operate at the more desirable level of nucleate boiling, if desired. The addition of the bubbles also produces more coolant vapor in the curtain of coolant, and the added vapor tends to rise up into the gap normally formed between the body of metal and the wall of the mold immediately above the curtain, to cool the metal at that level. As a result, the metal tends to solidify further up the wall than otherwise expected, not only as a result of the higher cooling rate achieved in the manner described above, but also as a result of the build-up of coolant vapor in the gap. The higher level assures the operator in turn that the metal will solidify on the wall of the mold at a level where lubricating oil is present; and together, all of these effects produce a superior, more satin-like, dragfree surface on the body of the metal over the entire length of the ingot.

Moreover, where the invention is employed in conjunction with the apparatus and technique described in U.S. Pat. No. 4,598,763, the invention has the further advantage that any gas and/or vapor released into the gap from the curtain, intermixes with the annulus of fluid discharged from the cavity of the mold by the patented apparatus and technique, and produces a more steady flow of the latter discharge, rather than the discharge occurring as intermittent pulses of fluid.

As indicated, the gas should have a low solubility in the liquid; and where the liquid is water, the gas may be air for cheapness and ready availability.

During the casting operation, the body of gas in the distribution chamber may be released into the coolant flow passage through the slot during both the butt forming stage and the steady state casting stage. Or the body of gas may be released into the passage through the slot only during the steady state casting stage. For example, during the butt forming stage, the coolant discharge rate may be adjusted to undercool the ingot by generating a film boiling effect; and the body of gas may be released into the passage through the slot when the temperature of the metal reaches a level at which the cooling rate requires increasing to maintain a desired surface temperature on the metal. Then, when the surface temperature falls below the foregoing level, the body of gas may no longer be released through the slot into the passage, so as to undercool the metal once again. Ultimately, when steady state casting is begun, the body of gas may be released into the passage once again, through the slot, and on an indefinite basis until the casting operation is completed. In the alternative, the coolant discharge rate may be adjusted during the butt forming stage to maintain the temperature of the metal within a prescribed range, and the body of gas may not be released into the passage through the slot until the coolant discharge rate is increased and the steady state casting stage is begun.

The rate of coolant discharge during the butt forming stage and the steady state casting stage, may be substantially the same, or varied from one stage to the other. Similarly, the rate of coolant discharge may be varied during each stage.

Preferably, as the body of gas is released through the slot, it is constrained to flow through a multiplicity of orifices which subdivide it into a multiplicity of gas jets. The orifices may be formed by a perforated strip in the slot; and the strip may be plastic, such as where a perforated membrane is interposed in the slot between the gas distribution chamber and the coolant flow passage. Or in the alternative, the strip may be metallic, such as where a perforated or crenulated metal band is interposed in the slot between the chamber and the passage.

Furthermore, the liquid coolant may undergo substantially rectilinear flow to the opening of the passage, after the gas jets are released into the same; or the liquid coolant may undergo curvilinear flow thereafter, including re-entrant flow to the opening of the passage after the gas jets are released into the same.

The gas jets may be released directly into the coolant passage; or indirectly through a spur at the periphery of the passage. The spur is preferably in line with that portion of the passage downstream from the point at which it merges with the passage.

In certain presently preferred embodiments of the invention, the liquid coolant is introduced to the passage through an annular retention chamber circumposed about the axis of the cavity in the body of the mold, to cool the mold. In some presently preferred embodiments of the invention, the retention chamber is disposed at the level of the cavity; and in other embodiments, the retention chamber is disposed at a level corresponding to that at which the coolant curtain impinges on the emerging ingot.

The inventive apparatus comprises means defining an annular flow passage which is circumposed about the cavity in the body of the mold to carry liquid coolant, and which opens into the ambient atmosphere of the mold adjacent the aforesaid opposite end opening thereof so as to direct the liquid coolant at the surface of the ingot as it emerges from the mold to extract heat from the same. In addition, the apparatus comprises means for introducing liquid coolant to the annular flow passage, and means defining an annular gas distribution chamber which is disposed about the flow passage in the body of the mold. These means are accompanied, moreover, by means for opening the chamber to the passage, including an annular slot disposed upstream from the discharge opening of the passage at the periphery of the coolant flow therein. They are also accompanied by means for charging a body of pressurized gas into the annular distribution chamber, and means for releasing the body of gas into the passage through the slot when the chamber is open to the passage. There are also means in the slot for subdividing the body of gas into a multiplicity of gas jets as the gas discharges through the slot, so that assuming that the gas is substantially insoluble in the coolant liquid, it is entrained in the flow of coolant as a mass of bubbles that tend to remain discrete and undissolved in the flow as it discharges through the opening of the passage and impinges on the emerging body of metal.

As indicated earlier, the means for subdividing the body of gas into gas jets may include means in the slot forming a multiplicity of orifices through which the gas is constrained to flow as it discharges into the coolant flow passage from the gas distribution chamber. And as was also indicated earlier, these means may take the form of a perforated strip in the slot, such as those described earlier. Similarly, the coolant flow passage may have the character described earlier with respect to that portion of it downstream from the slot or other point at which the body of gas is released into the passage; and the apparatus may further comprise an annular retention chamber for the liquid coolant which is interconnected with the passage to supply the same with coolant as described earlier. Moreover, the mold may have means formed in the body thereof about the cavity thereof to provide the fluid annulus mentioned earlier in connection with U.S. Pat. No. 4,598,763.

In most presently preferred embodiments of the invention, the gas is charged into the distribution chamber through valve means or the like which are operable to prevent backflow into the gas supply means from the coolant flow passage.

In certain presently preferred embodiments of the invention the mold takes the form of assembled parts, and the gas distribution chamber takes the form of a groove in the face of one part which is opposed to the face of another part when the parts are assembled. In some of these embodiments, the coolant flow passage is defined by the aforesaid faces of the respective parts; and in one group of these embodiments, there is a strip disposed in the groove which is perforated to subdivide the body of gas into a multiplicity of jets when the gas is discharged through the mouth of the groove. In another group, there is a strip of one part disposed in the slot on the face thereof, which is perforated or crenulated to subdivide the body of gas into a multiplicity of jets when the gas is discharged through the strip.

BRIEF DESCRIPTION OF THE DRAWINGS

These features will be better understood by reference to the accompanying drawings which illustrate the invention as it is employed in conjunction with the apparatus and technique of U.S. Pat. No. 4,598,763.

In the drawings.

BEST MODE FOR CARRYING OUT THE INVENTION

Figure 1:
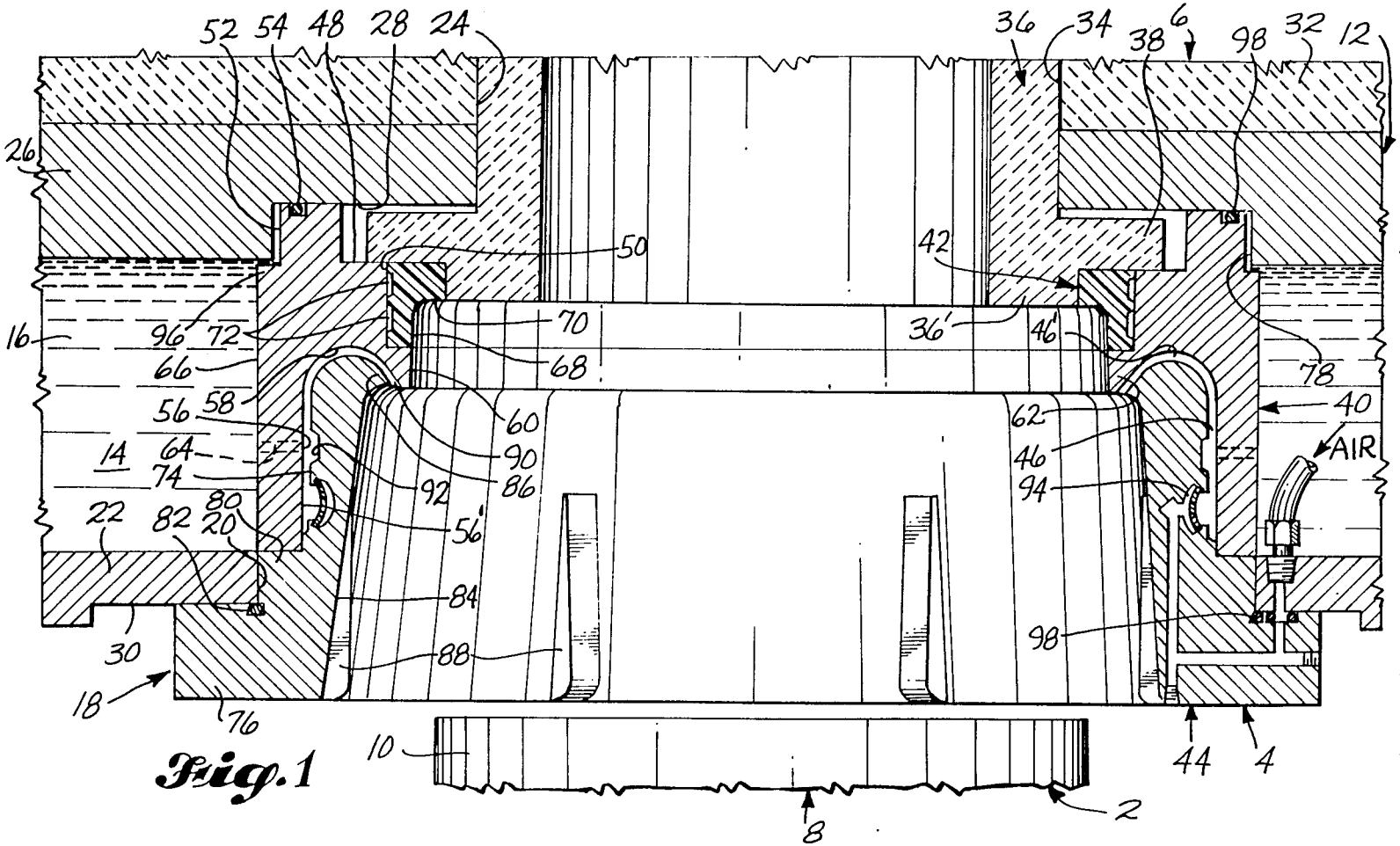
FIG. 1 is a cross-sectional view of a multiple-site billet casting apparatus along the axis of one site therein.
Figure 2:
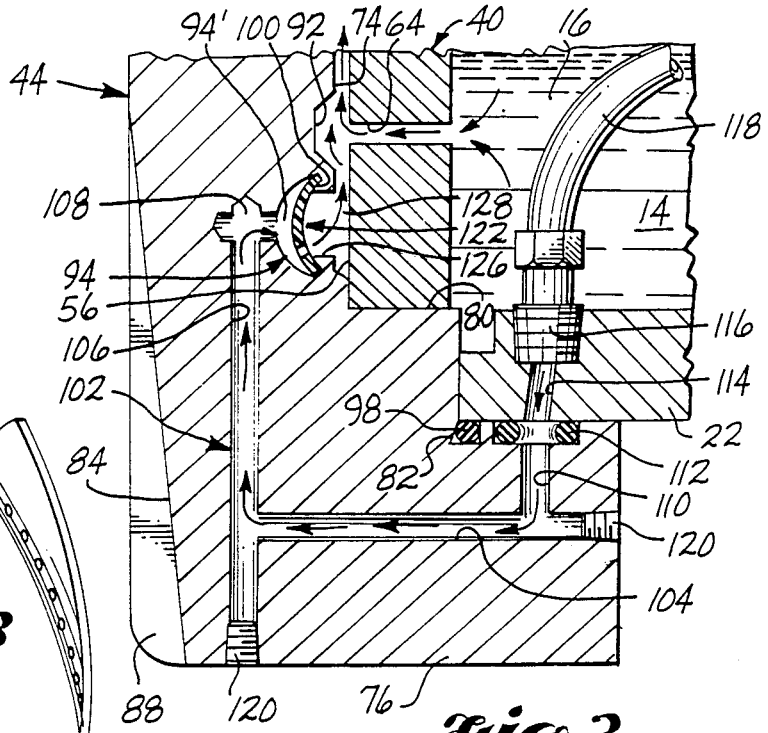
FIG. 2 is a similar view at the lower right hand corner of FIG. 1, but on a larger scale.
Figure 3:
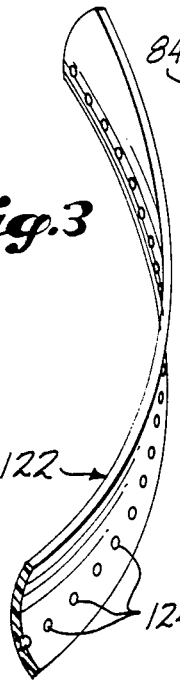
FIG. 3 is a part perspective view of an elastomeric membrane employed in the apparatus of FIGS. 1 and 2.

Referring first to FIGS. 1–3, it will be seen that, as in U.S. Pat. No. 4,598,763, the billet casting apparatus 2 comprises a multiple site casting device 4 of the coolant box-type, a hot top 6 for feeding the respective casting sites 8 of the device, and an assembly of telescoping stools 10 for supporting the billets of metal (not shown) progressively formed at the sites. The casting device 4 comprises a large, widely-dimensioned box 12 having a correspondingly sized chamber 14 therein. The chamber 14 contains a liquid coolant 16, such as water, which is circulated about a set of annular casting molds 18 installed at the respective casting sites 8. The molds 18 are installed in a plurality of equally sized openings 20 in the bottom 22 of the box 12, and are vertically aligned with smaller, but equally sized openings 24 in the top 26 of the box. The molds 18 are also mated with annular rabbets 28 formed about the inner peripheral edges of the top openings 24 of the box, and with annular rabbets 30 formed about the outer peripheral edges of the bottom openings 20 of the box.

The hot top 6 comprises a molten metal distribution pan 32 which rests on top of the box 12 and has a plurality of apertures 34 therein that are adapted to register with the top openings 24 of the box. The pairs of openings 24 and apertures 34 are equipped in turn with insulative refractory scuppers 36 which are flanged at an intermediate level thereof and installed in the pairs of openings and apertures by inserting them upwardly into the same through the corresponding bottom openings 20 of the box. As the scuppers 36 slidably engage in the pairs of openings 24 and apertures 34, the flanges 38 of the same are received in the rabbets 28 of the openings. Meanwhile, the bottom portions 36' of the scuppers remain depending within the chamber 14 at the respective sites 8, and are mated to the molds 18, and vice versa, when the latter are installed at the sites, as shall be explained.

Each casting mold 18 comprises a deep, cylindrically surfaced metal casting ring 40; a more shallow, but similarly cylindrically surfaced graphite feed ring 42 of smaller inner and outer diameter; and a widely flanged metal attachment ring 44 that cooperatively inserts within the casting ring 40 to define a coolant flow passage 46 therebetween, as shall be explained. At its top, the casting ring 40 has a wide diameter rabbet 48 on the inner peripheral edge thereof; and the rabbet 48 in turn has a narrower, more deeply inset rabbet 50 at the inner peripheral edge thereof. The casting ring 40 also has an outer peripheral rabbet 52 at the top thereof, which is inset to the same depth as that of the rabbet 48. There is also an annular groove 54 in the top of the casting ring, between the two rabbets 48 and 52. At its bottom, the casting ring 40 has a high, inner peripheral rabbet 56, the top 58 of which is arcuately recessed to a line just short of the inner peripheral face 60 of the ring, thus leaving an annular toe 62 about the inner periphery of the ring at the top thereof. The vertical wall 56' of the rabbet 56 has a series of symmetrically angularly spaced holes 64 therein, which open into the outer peripheral face 66 of the ring.

Though smaller, the feed ring 42 is similarly configured in that it too has a high inner peripheral rabbet 68, the top of which has an arcuate recess 70 therein. However, the feed ring has a plain top, and there is a pair of vertically spaced circumferential grooves 72 in the outer peripheral face of the ring.

As indicated, the attachment ring 44 has a deeply inset, outer peripheral rabbet 74 about the top thereof, so as to telescope within the lower inner peripheral rabbet 56 of the casting ring, yet have a flange 76 which is greater in diameter than the outer peripheral face 66 of the casting ring 40. The flange 76 has an annular step 80 at the inside thereof, which is also of greater diameter than the face 66 of the ring 40, and there is an annular groove 82 about the flange 76 at the bottom of the step 80. The inner peripheral face 84 of the ring has a slightly conical configuration which is rounded or filleted at the top to form an overhanging annular lip 86 thereon. There is also a series of symmetrically angularly spaced, bottom chamfered ribs 88 about the inner peripheral face of the ring which are greater in diameter than the lip 86 of the ring.

The feed ring 42 is adapted to be seated within the smaller, upper inner peripheral rabbet 50 of the casting ring 40, and when seated, is flush with the bottom of the larger, upper inner peripheral rabbet 48 of the ring, as well as with the inner peripheral face 60 of the casting ring. The attachment ring 44 is adapted to be slidably inserted in the lower, inner peripheral rabbet 56 of the casting ring, until the step 80 thereof abuts the bottom of the ring. At a point slightly above the step, the wall of the outer peripheral rabbet 74 of the attachment ring is relieved in diameter so that, as indicated, an annular passage 46 for coolant is formed between the two rings 40 and 44. At its top, moreover, the attachment ring 44 is rounded to a semi-toroidal configuration corresponding to the recess at the top 58 of the rabbet 56 in the casting ring 40. But the top of the attachment ring is not the same height as the recess of the casting ring, so that an arched continuation 46' of the passage is formed between the two rings. Ultimately, the toe 62 and lip 86 of the two rings form an annular opening 90 therebetween for the discharge of coolant 16 from the passage 46 at an acute angle to the axis of the rings.

Inside the passage, there is a pair of circumferential grooves 92 and 94 in the reduced diameter wall of the rabbet 74 of the attachment ring. The grooves 92 and 94 are vertically spaced from one another, and are adapted to lend themselves to the bubble entraining features of the invention, as shall be explained.

The flange 76 of the attachment ring 44 of each mold 18 has a greater diameter than the corresponding bottom opening 20 of the box; whereas the step 80 has a diameter substantially the same as that of the opening. Moreover, the outer peripheral face 66 of the casting ring has a diameter greater than the shoulder 78 of the rabbet 28 about the top opening 24 of the box; whereas the wall of the outer peripheral rabbet 52 of the casting ring has substantially the same diameter as that of the rabbet 28. The feed ring 42, on the other hand, has an inside diameter substantially the same as the outside diameter of the depending portion 36' of the scupper. Accordingly, when the three rings 40, 42 and 44 are assembled, and the resulting mold 18 is inserted in the box 12 through the bottom opening 20 thereof, the feed ring 42 mates with the scupper 36 about the depending portion 36' thereof, and the casting ring 40 inserts telescopically between the scupper and the shoulder 78 of the rabbet 28 of the top opening 24 of the box. Meanwhile, the two outer rings 40 and 44 are adapted so that the casting ring 40 abuts the top of the rabbet 28, the flange 76 of the attachment ring 44 abuts the rabbet 30 on the bottom of the box, and an annular sealing ring (not shown) is trapped between the shoulder 96 of the casting ring and the shoulder 98 on the top of the box, as in U.S. Pat. No. 4,598,763. At the same time, the top of the feed ring 42 and the larger inner peripheral rabbet 48 of the casting ring abut the flange 38 of the scupper 36, after a pair of elastomeric O-rings 98 is trapped between the outer rings 40, 44 and the box 12, in the grooves 54 and 82 of the rings. Cap screws (now shown) are normally employed to secure the outer rings to one another, and the mold to the box.

When the apparatus is put to use, the stools 10 are telescopically inserted within the molds 18, the ribs 88 serving meanwhile as guides for the caps of the stools. Molten metal is introduced into the molds from the pan 32, and after splaying about the inner peripheral edges of the scuppers, the metal forms into billet-like bodies of metal (not shown) on the tops of the stools 10. The stools are then reciprocated with respect to the molds, so that as more molten metal is added to the molds, the bodies of metal are progressively elongated through the bottom openings 84 of the molds. See U.S. Pat. No. 4,598,763 in this connection. Meanwhile, curtains of liquid coolant 16 are discharged onto the emerging bodies of metal from the openings 90 of the passages 46, and as explained in U.S. Pat. No. 4,598,763, oil and gas are diffused through the bodies of the feed rings 42 from the grooves 72, to assist in the molding operation. The system of internal ducting for this purpose is not shown in the drawings, however, to simplify the illustration of the present invention The coolant 16 for the respective curtains is supplied by the chamber 14, and discharges into the respective passages 46 through the holes 64 in the walls 66 of the casting rings. The coolant then flows upwardly between the casting and attachment rings, then reentrantly downwardly through the openings 90 of the passages, and ultimately angularly downwardly onto the emerging bodies of metal. As explained earlier, the rate at which each body of metal is cooled by the corresponding curtain of coolant, is a function in part of the velocity of the coolant as it exits through the opening 90 of the respective passage and impinges on the surface of the metal. This velocity can be controlled, according to the present invention, by infusing the coolant flow with a mass of tiny, discrete, undissolved bubbles of air or other gas, which operates to increase the velocity of the coolant and thus the ability to control the cooling rate itself through the control of the combination of velocity and coolant discharge rate.

Referring agains to FIGS. 1–3, it will be seen that the upper circumferential groove 92 of the attachment ring 44 is slightly chamfered at the top and bottom thereof, and is disposed opposite the series of entry holes 64 in the casting ring 40. The lower groove 94 is recessed more deeply into the attachment ring, and the inner peripheral portion 94' (FIG. 2) of the groove is routed out so as to be of concave cross-section, larger than the mouth 126 of the groove in width, and indented to the top and bottom of the groove, thus leaving annular shoulders 100 on the top and bottom of the groove, midway the radial depth thereof. In addition, the attachment ring 44 has a system 102 of interconnecting fluid flow passages therein which are supplied with compressed gas through the bottom 22 of the box, and operative in turn to supply the groove 94 with gas for the bubbling effect, as shall be explained. The system 102 of passages includes a radially inwardly directed hole 104 in the outer peripheral edge of the flange 76 of the attachment ring 44, which is interconnected at its inside end with an intermediate point of a vertical hole 106 in the bottom of the flange 76. The hole 106 in turn interconnects with a right angular elbow 108 opening into the inner peripheral portion 94' of the groove. The hole 104 is supplied with gas through a hole 110 opening into the top of the flange, which is countersunk at its opening to contain an elastomeric sealant ring 112. The gas is fed to the hole 110 through an opposing hole 114 in the bottom of the box, which is again countersunk at its top and threaded to receive a nipple 116 on the end of a supply hose 118 passed into the casting device through the chamber 14 of the box. The hose 118 is flexible and is fed with gas from a source (not shown) external of the box. Plugs 120 are inserted in the ends of the holes 104 and 106 to close off the system 102 to the outside, so that the gas from the hose 118 is fed exclusively to the groove 94, as illustrated in FIG. 2.

At the time the mold 18 is assembled, an annular membrane 122 of a flexible, low water absorptive plastic material, such as a polycarbonate material, is added to the groove 94. The membrane 122 is adapted so that when flexed and inserted in the groove, it will snap engage behind the shoulders 100 in the top and bottom of the same. In this condition, the membrane 122 is effectively locked and sealed in place by the action of the gas driving the toggled edges of the membrane more deeply into the indentations of the shoulders 100 of the groove 94. Meanwhile, the gas is released into the passage 46 through a series of symmetrically angularly spaced orifices 124 in the bottom portion of the membrane. The orifices 124 operate to subdivide the body of gas into a multiplicity of gas jets (not shown). The jets are released into the coolant flow through the mouth 126 of the groove; and according to the invention, the gas is substantially insoluble in the coolant and the jets are released from the orifices 124 at a temperature and pressure at which each jet forms a string of tiny, discrete, undissolved bubbles of gas (the arrow 128) that tend to remain discrete and undissolved in the flow as the coolant issues through the discharge opening 90 of the passage 46 and impinges on the emerging body of metal. The effect on the coolant flow in turn, is to increase the velocity of the same at the surface of the metal, so that, as indicated, the cooling rate can be controlled in accordance with the coolant discharge rate that was selected.

Figure 4:
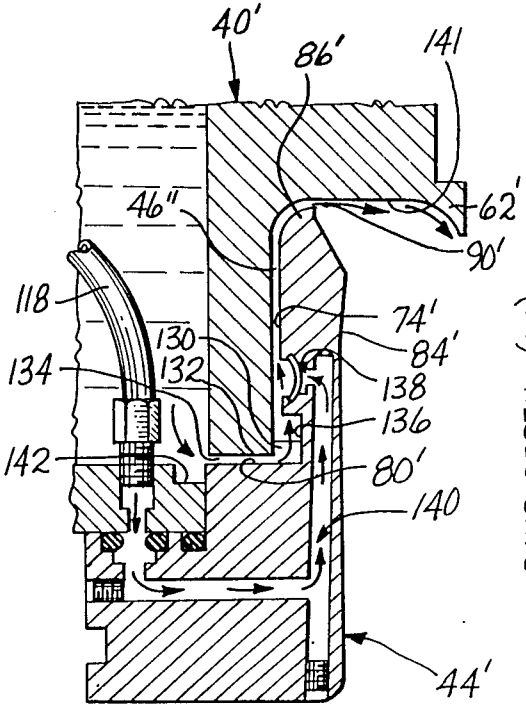
FIG. 4 is a view similar to that of FIG. 2, but illustrating a modified version of the bubble entraining mechanism employed in the apparatus of FIGS. 1–3.

In the embodiment of FIG. 4, the step 80' of the attachment ring 44' has a series of shallow benches 130 angularly spaced about the top thereof, which are rabbeted in themselves at 132 to mate with the bottom of the casting ring 40' when the attachment ring 44' is telescoped therewithin. The holes 64 in the embodiment of FIGS. 1–3 are omitted, and the coolant is discharged from the chamber 14 through the annular gaps 134 between the benches. Meanwhile, the wall of the outer peripheral rabbet 74' in the attachment ring has a circumferential groove 136 about the bottom thereof, adjacent the top of the step 80', which provides an enlargement for the bottom of the passage 46''. The upper groove 138 is equipped in the manner of FIGS. 1–3, to bubble an insoluble gas into the coolant flow; and the groove 138 is supplied in turn by a system 140 of passages which are formed in the attachment ring, as in the embodiment of FIGS. 1–3. Of course, contrary to the latter embodiment, the coolant enters the coolant flow passage 46'' upstream from the gas supply groove 138, and the bubbles are released into the coolant flow relatively downstream from the point at which the coolant enters the passage. Contrary to the embodiment of FIGS. 1–3, moreover, the attachment ring 44' has a more cylindrical configuration at the inner peripheral face 84' thereof, so that the lip 86' and toe 62' of the rings 40' and 44' are widely spaced at the mouth 141 of the opening 90' of the passage, thus providing a flare to the mouth.

Preferably, the bottom of the chamber has an annular groove 142 about the inner peripheral edge thereof, to aid in the discharge of the coolant from the chamber 14 into the passage 46''.

Figure 7:
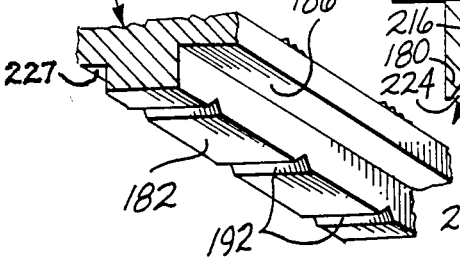
FIG. 7 is a part perspective view of the orifice-forming means employed in the apparatus of FIGS. 5 and 6.
Figure 6:
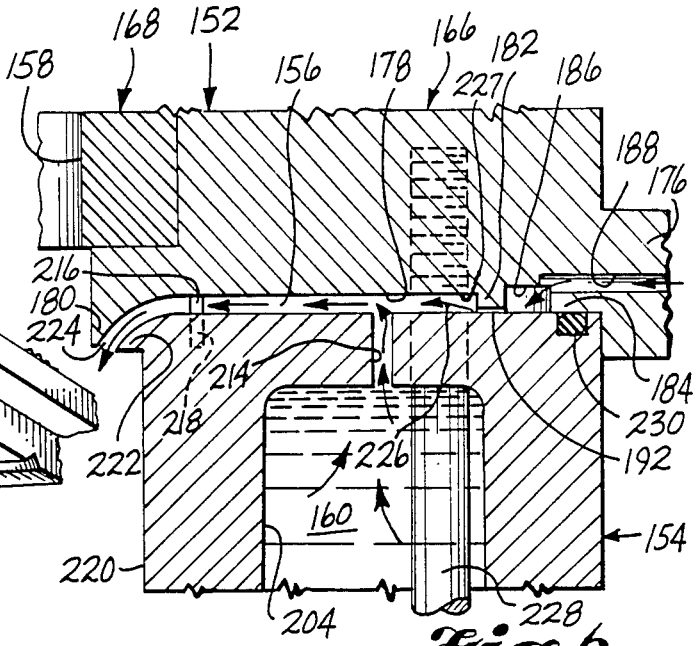
FIG. 6 is a similar view at the lower right hand corner of FIG. 5, but again on a larger scale.
Figure 5:
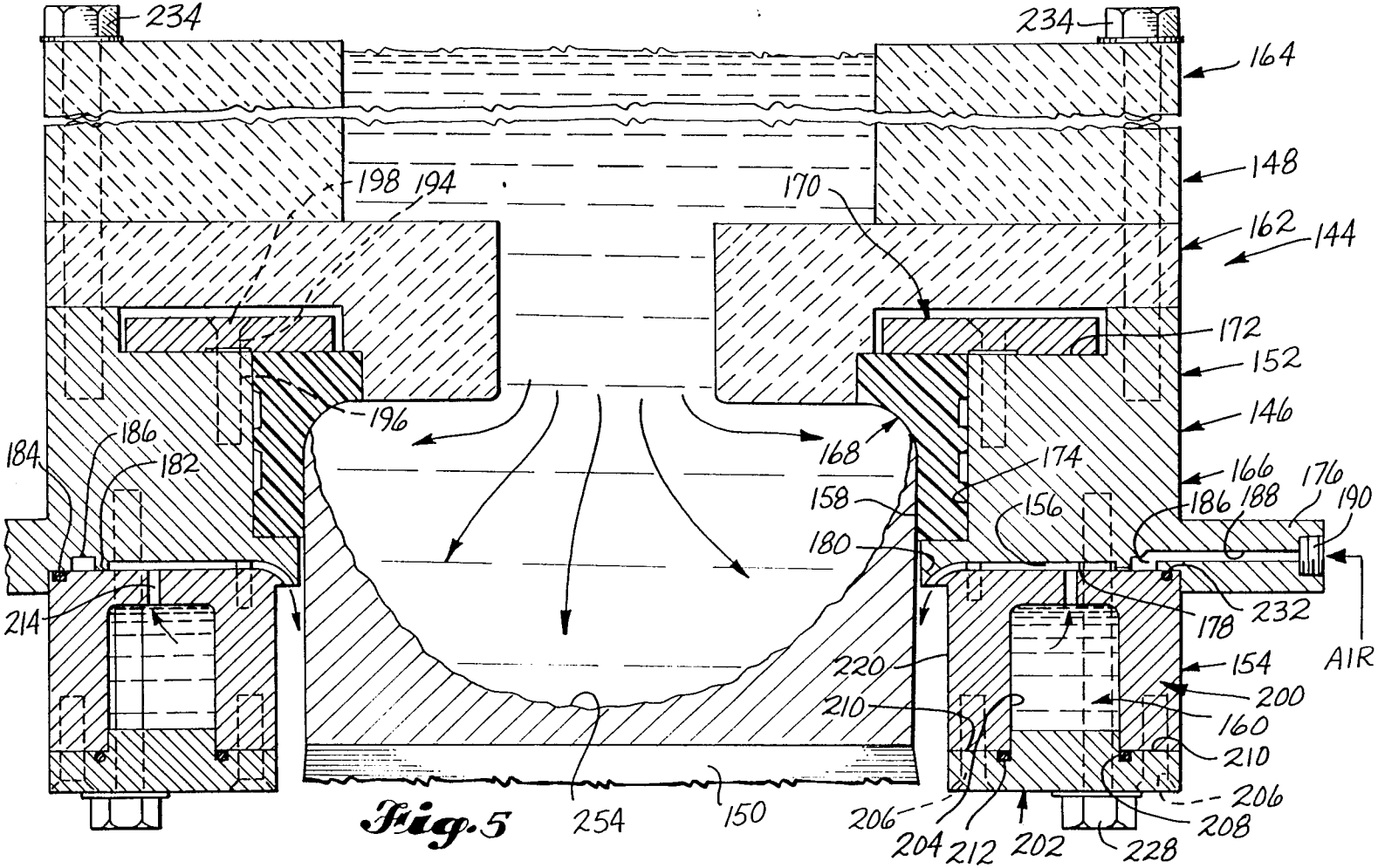
FIG. 5 is an axial cross-sectional view of a sheet ingot casting apparatus equipped with an alternative means for entraining bubbles of gas in the curtain-forming coolant of the same.

The casting apparatus 144 in FIGS. 5–7 is adapted to cast sheet ingot or the like having a rectangular cross-section, rather than a rounded one. Therefore, a modified approach is used in bubbling the gas into the coolant flow. The casting apparatus 144 comprises a single-site casting device 146 of the coolant jacket-type, a hot top 148 for feeding the casting device, and a telescoping stool 150 for supporting the ingot of metal progressively formed in the device. The casting device 146 comprises a pair of annular metal sections 152 and 154 which are stacked on top of one another and adapted to form a bubble-fed coolant flow passage 156 therebetween, as shall be explained. The upper section 152 defines the casting surface 158, and the lower section 154 defines a coolant jacket 160 for the same. The hot top 148 also comprises a pair of stacked annular sections 162 and 164, which, however, are refractory in composition. The lower refractory section 162 defines a pan and scupper for the molten metal; the upper section 164 defines containment walls for the molten metal in the pan.

More specifically, the upper section 152 of the casting device 146 comprises an annular metal casting ring 166, a graphite feed ring 168, and a disc-shaped metal hold down ring 170 for the feed ring. Once again, the casting ring 166 is cylindrically surfaced, and has an inner peripheral rabbet 172 which is equipped with a narrower, deeper rabbet 174 at the inner peripheral edge thereof. In this instance, however, the body of the casting ring also has a wide diameter flange 176 about the outer periphery thereof and at the bottom thereof. Moreover, inside of the flange 176, the bottom of the ring has an annular recess 178 therein which is substantially radially co-extensive with the body of the ring. The recess 178 terminates just short of the inside edge of the ring, however, and is rounded or filleted to leave an annular toe 180 about the inner periphery of the ring. Also, adjacent the flange 176, the recess 178 is reduced in depth, and adapted so that there is an annular rib 182 and an annular step 184 formed in the recess, at the outer periphery thereof. The rib and step are separated by an annular groove 186 therebetween, which is functionally comparable to the grooves 94 and 138 in the embodiments of FIGS. 1–4, as shall be explained. Accordingly, there is a radial hole 188 in the flange 176 of the casting ring 166 which communicates with the grove 186 and has a threaded countersink 190 at the opening thereof, on the edge of the flange. The countersink 190 is adapted to receive the nipple of a gas feed hose (not shown), and to supply compressed gas to the groove 186 in the manner the systems 102 and 140 of passages did so in the embodiments of FIGS. 1–4. Moreover, the annular rib 182 has a series of inverted V-shaped, angularly spaced radial indentations 192 therein (FIGS. 6 and 7) which operate to discharge the gas from the groove 186 in the manner of the orifices 124, as shall be explained.

The feed ring 168 is similar to that shown in FIGS. 1–4, and once again, is adapted to be seated in the narrower inner peripheral rabbet 174 of the casting ring 166, but with a slightly smaller inside wall diameter than that of the ring. As before, moreover, the top of the feed ring is flush with the bottom of the wider diameter rabbet 172 in the casting ring.

The hold down ring 170 is adapted to rest on top of the casting ring 166 in the rabbet 172 thereof, and to overlie the outer peripheral portion of the feed ring 168. A series of individually countersunk angularly spaced holes 194 in the hold down ring register with a corresponding series of threaded holes 196 in the bottom of the rabbet 172, to enable cap screws 198 to be used in clamping the feed ring in place on the casting ring.

The lower section 154 of the casting device comprises a pair of relatively stacked chamber defining rings 200 and 202, the upper of which, 200, has an inverted U-shaped cross-section, and the lower of which, 202, is rabbeted at the inner and outer peripheries thereof to mate with the channel 204 in the upper ring 200. Once again, cap screws 206 are employed to clamp one ring to the other; and a pair of annular grooves 208 is employed in the rabbets 210 of the cover ring to hold a pair of elastomeric O-rings 212 which serve to seal the resulting chamber 204 against leakage. The chamber 204 is supplied with liquid coolant in a manner not shown, and the coolant is discharged onto the top surface of the lower section 154 through a series of angularly spaced holes 214 in the top of the upper ring 200.

The top of the lower section 154 is adapted to mate with the recess 178 in the bottom of the upper section 152 when the sections are stacked on top of one another. However, before the sections are stacked on top of one another, a set of pins 216 is inserted upright in a series of angularly spaced holes 128 arranged about the inner peripheral portion of the lower section, at the top of the upper ring 200. The pins 216 serve as spacer elements and are adapted to abut the top of the recess 178 when the outer peripheral portion of the lower section abuts the rib 182 and step 184 at the outer periphery of the recess. The inner peripheral face 220 of the upper ring 200 of the lower section is rabbeted, moreover, to provide an overhanging annular lip 222 at the top thereof, corresponding to the lip 86 in the embodiment of FIGS. 1–3; and together the lip 222 and the toe 180 of the upper section 152 define the opening 224 of an annular passage 156 formed between the two sections in the gap left by the pins 216. In use, the passage 156 serves to discharge the liquid coolant exiting from the chamber 160 through the holes 214. Meanwhile, at the rib 182, the gas introduced into the groove 186 is subdivided into a multiplicity of radially inwardly directed gas jets (the arrow 226) which discharge from the crenels or indentations 192 of the rib to infuse the inflowing coolant with strings of tiny, discrete, undissolved bubbles of gas in the manner achieved by the membrane 122 in the embodiments of FIGS. 1–4. The gas strings 226 are released into the coolant, however, through the medium of a lateral spur 227 which is in line with the passage 156, radially outside of the holes 214.

Elongated cap screws 228 are employed to bolt the two sections 152 and 154 together when the casting device is made up; and an elastomeric O-ring 230 is seated in an annular groove 232 about the outer periphery of the lower 154 section of the device, at the top thereof, to seal the gas supply system against loss of gas at the groove 186.

Additional cap screws 234 are used to secure the hot top 148 to the casting device 146, as well as clamp together the respective components 162, 164 of the hot top.

Figure 8:
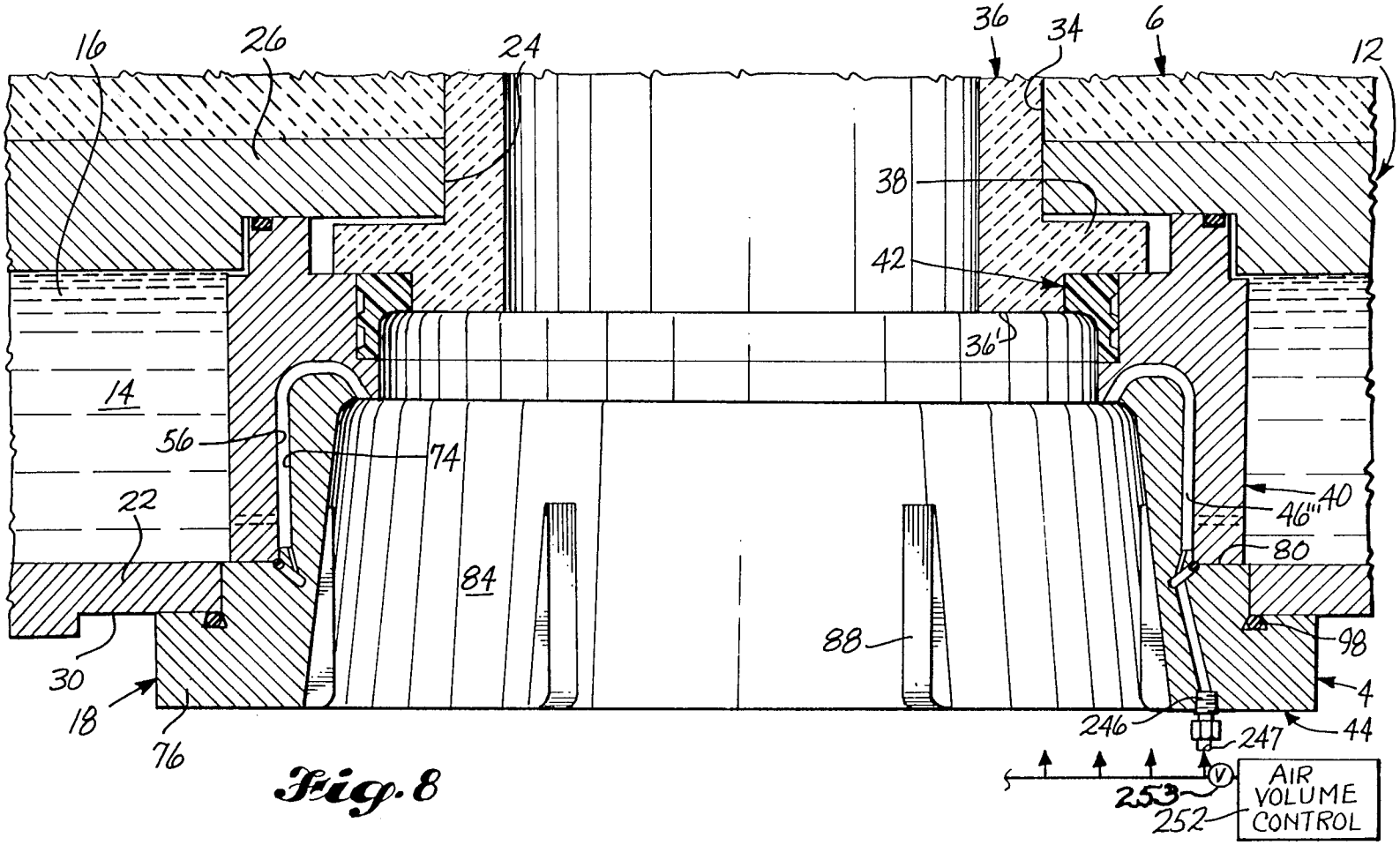
FIG. 8 is an axial cross-sectional view of a multiple site billet casting apparatus equipped with an alternative mechanism for entraining bubbles in the curtain-forming coolant thereof.
Figure 9:
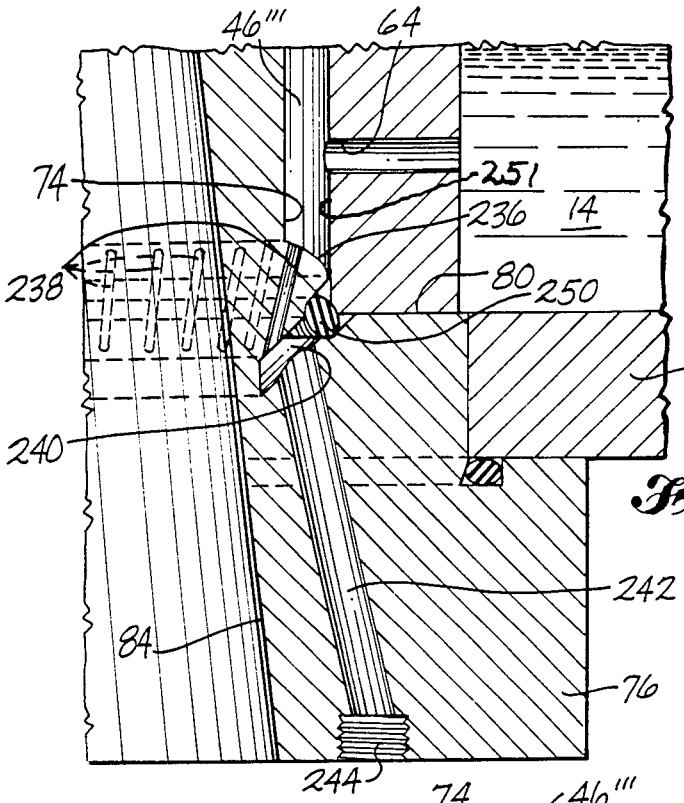
FIG. 9 is a similar view at the lower right hand corner of FIG. 8, but on an enlarged scale.
Figure 10:
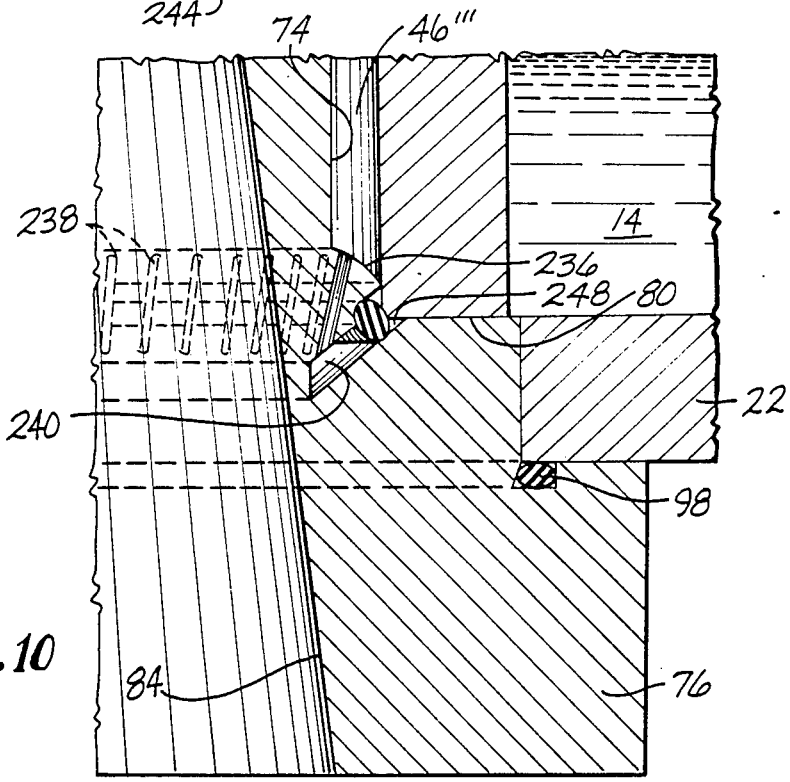
FIG. 10 is a similar view of the same corner, and on an enlarged scale, but rotated angularly from that of FIGS. 8 and 9 to further illustrate the character of the bubble entraining mechanism.

The embodiment of FIGS. 8–10 is similar to that of FIGS. 1–3 and therefore, with a few exceptions, similar numerals are employed throughout. The embodiment of FIGS. 8–10 differs, however, in the manner in which bubbles are infused into the coolant flow. In this instance, the gas is supplied at the bottom of the attachment ring 44, and is introduced to the passage 46''' between the casting and attachment rings, at the bottom of the passage. As in the embodiment of FIGS. 1–3, the outer peripheral rabbet 74 of the attachment ring is adapted so that the attachment ring first telescopes within the casting ring, and then undergoes a reduced diameter to form the passage 46''' between the rings. The slight additional step 236 thus formed between the original step 80 on the flange 76 of the attachment ring, and the wall of the rabbet 74, is now employed as the site for the mechanism by which the bubbles are introduced to the coolant flow. Moreover, metal formed orifices are employed, rather than the orifices of a plastic membrane, as in the embodiment of FIGS. 1–3. Referring to FIGS. 9 and 10 in particular, it will be seen that the top of the additional step 236 is chamfered to a slightly rounded configuration, and there is a series of angularly spaced, radially inwardly and downwardly inclined orifice sized holes 238 machined or otherwise formed in the same. Underlying the series of holes, at the corner 248 between the steps 80 and 236, is an annular groove 240 which is acutely angled to the steps at a flatter angle than that of the holes 238 themselves. The groove is supplied with gas by a hole 242 which is upwardly directly to the same from the bottom of the attachment ring. Once again, the inlet opening 244 of the gas-supply hole 242 is countersunk and threaded to receive the nipple 246 of a gas feed hose 247, as in the previous embodiments. Additionally, the groove 240 is countersunk, at the corner 248 between the steps, to receive an elastomeric O-ring 250 which operates to plug the groove above the point at which the hole 242 opens into the same from below. The orifice-sized holes 238, meanwhile, intersect the groove below the O-ring 250, so that the gas fed to the groove from the supply hole 242, discharges into the passage 46''' through the orificed-sized holes 238. In doing so, the gas is once again subdivided into a multiplicity of gas jets which are released upwardly into the passage through a short spur 251 below the coolant supply holes 64 from the chamber 14.

In all embodiments, the flow rate to the hoses 118 or 247 of the respective casting sites 8 is controlled relative to the coolant flow, by gas volume control means 252. These means assure that the gas is subdivided in the manner described as it exits through the various orifices 124, 194 and 238 of the embodiments. The volume control means also include a check valve 253 or the like which prevents backflow of liquid into the same when the gas is not being supplied to the bubble infusion mechanisms of the various embodiments.

It is known that the rate at which a body of metal undergoes cooling when emerging from a mold, can be determined by measuring the depth of the liquid-solid interface of the body, that is, the sump 254 seen in FIG. 5. If the effective cooling rate undergoes an increase, then the depth of the sump will decrease. Conversely, a decrease in the cooling rate causes the sump to deepen.

Figure 11:
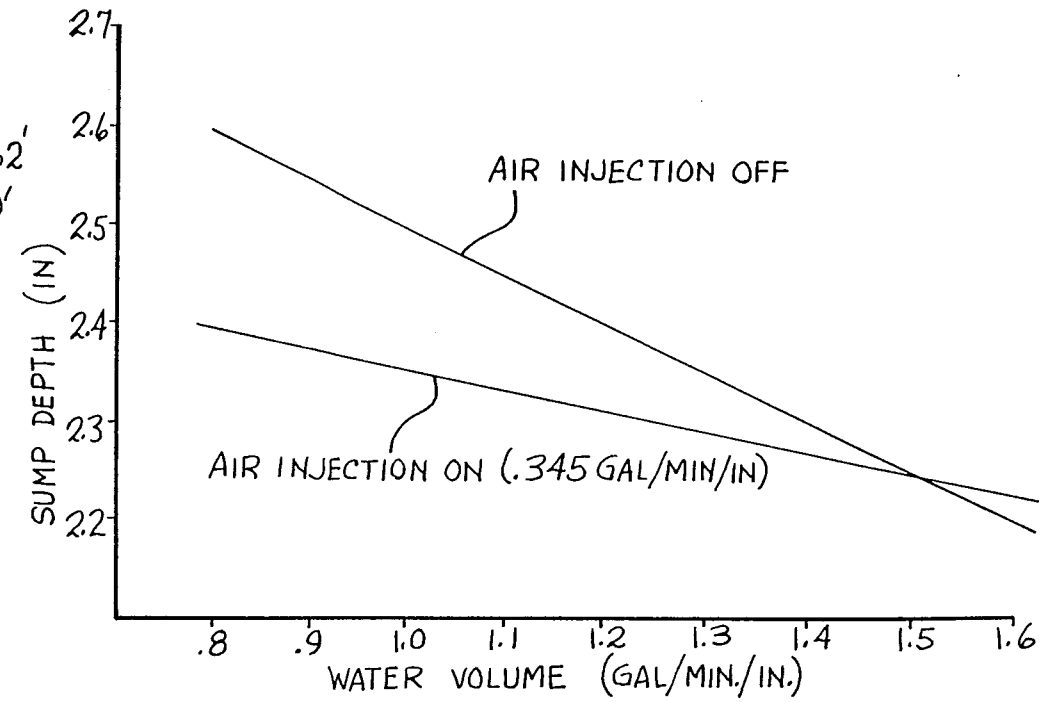

Experiments were conducted to determine the depth of the sump of a molten metal aluminum body when a curtain of coolant was discharged onto the emerging body of metal, both with and without bubbles infused therein. The mold was a six inch deep hot-top-equipped casting mold of the type shown in FIGS. 1–3, and equipped with the bubble injection means shown therein. Water was employed as the coolant, and was discharged through an opening 90, 0.06 inch in width. 6063 aluminum alloy was cast in the apparatus at an operating speed of six inches per minute, and at a metal temperature of 1275°±8° F. The water temperature was 50° F., and as seen in FIG. 11, the water volume was varied from 0.8 to 1.6 gallons per minute per inch of circumference.

For one series of experiments, the water was discharged onto the aluminum body without any bubbles entrained therein. For another set, air bubbles were infused in the water flow, using an air volume of 3.45 gallons per minute per inch of circumference. FIG. 11 is a plot of the sump depth versus the water volume, with and without the injection of air. The increased cooling effect with air injection can be readily seen. The effect is more pronounced at low water flows, and becomes less effective as the flow rate increases.

Sump depth was determined by inserting a small metal rod into the mold cavity from the top thereof and lowering the rod until the solidified surface of the molten aluminum body was reached. The rod was held there only momentarily so as to not freeze it into the solidifying metal body. By determining how far the rod had been inserted when the solid interface of the body was reached, the depth of the sump could be determined relative to the top of the mold.

I claim:

1. In the process of continuously casting metal as ingot by introducing molten metal to the cavity of an annular mold, through one end opening thereof, and while the metal undergoes partial solidification in the mold to form a body of the same on a support adjacent the other end opening of the cavity, reciprocating the mold and support in relation to one another endwise of the cavity to elongate the body of metal through the latter opening of the cavity, the improvement comprising:

introducing liquid coolant to an annular flow passage which is circumposed about the cavity in the body of the mold and opens into the ambient atmosphere of the mold adjacent the aforesaid opposite end opening thereof to discharge the coolant as a curtain of the same that impinges on the emerging body of metal for direct cooling of the same, a gas, which is substantially insoluble in the coolant liquid, under pressure into an annular distribution chamber which is disposed about the passage in the body of the mold and opens into the passage through an annular slot disposed upstream from the discharge opening of the passage at the periphery of the coolant flow therein, releasing the body of gas in the chamber into the passage through the slot, subdividing the body of gas into a multiplicity of gas jets as the gas discharges through the slot, and releasing the gas jets into the coolant flow at a temperature and pressure at which the gas is entrained in the flow as a mass of bubbles that tend to remain discrete and undissolved in the coolant as the curtain of the same discharges through the opening of the passage and impinges on the emerging body of metal.

2. The process according to claim 1 wherein an annulus of fluid is formed in the cavity about the body of metal, which tends to flow relatively away from the one end opening of the cavity toward the level at which the coolant curtain impinges on the emerging ingot.

3. The process according to claim 1 wherein the coolant liquid is water and the gas is air.

4. The process according to claim 1 wherein the body of gas in the distribution chamber is released into the coolant flow passage through the slot during the butt forming stage and the steady state casting stage of the casting operation.

5. The process according to claim 1 wherein the body of gas in the distribution chamber is released into the coolant flow passage through the slot only during the steady state casting stage of the casting operation.

6. The process according to claim 1 wherein during the butt forming stage of the casting operation, the coolant discharge rate is adjusted to undercool the ingot by generating a film boiling effect, and the body of gas in the distribution chamber is released into the coolant flow passage through the slot when the temperature of the metal reaches a level at which the cooling rate requires increasing to maintain a desired surface temperature on the metal; then, when the surface temperature falls below the foregoing level, the body of gas is no longer released through the slot into the passage, so as to undercool the metal once again; and ultimately, when steady state casting is begun, the body of gas is released into the passage once again through the slot.

7. The process according to claim 1 wherein during the butt forming stage of the casting operation, the coolant discharge rate is adjusted to maintain the temperature of the metal within a prescribed range, and the body of gas in the distribution chamber is not released into the coolant flow passage through the slot until the coolant discharge rate is increased and the steady state casting stage of the operation is begun.

8. The process according to claim 1 wherein the rate of coolant discharge during the butt forming stage and the steady state casting stage of the operation are substantially the same.

9. The process according to claim 1 wherein the rate of coolant discharge during the butt forming stage and the steady state casting stage of the operation vary from one stage to the other.

10. The process according to claim 1 wherein the rate of coolant discharge is varied during each of the butt forming stage and the steady state casting stage of the operation.

11. The process according to claim 1 wherein as the body of gas is released through the slot, it is constrained to flow through a multiplicity of orifices which subdivide it into a multiplicity of gas jets.

12. The process according to claim 11 wherein the orifices are formed by a perforated strip in the slot.

13. The process according to claim 12 wherein the strip takes the form of a perforated plastic membrane.

14. The process according to claim 12 wherein the strip takes the form of a perforated or crenulated metallic band.

15. The process according to claim 1 wherein the liquid coolant undergoes substantially rectilinear flow to the opening of the passage after the gas jets are released into the same.

16. The process according to claim 1 wherein the liquid coolant undergoes curvilinear flow to the opening of the passage after the gas jets are released into the same.

17. The process according to claim 16 wherein the liquid coolant undergoes re-entrant flow to the opening of the passage after the gas jets are released into the same.

18. The process according to claim 1 wherein the gas jets are released directly into the coolant passage.

19. The process according to claim 1 wherein the gas jets are released into the coolant passage through a spur at the periphery of the passage.

20. The process according to claim 19 wherein the spur is collinear with that portion of the passage downstream from the point at which it merges with the passage.

21. The process according to claim 1 wherein the liquid coolant is introduced to the passage through an annular retention chamber circumposed about the axis of the cavity in the body of the mold, to cool the mold.

22. The process according to claim 21 wherein the retention chamber is disposed at the level of the cavity.

23. The process according to claim 21 wherein the retention chamber is disposed at a level corresponding to that at which the coolant curtain impinges on the emerging ingot.

24. In apparatus for continuously casting metal as ingot by introducing molten metal into the cavity of an open ended mold at one end opening thereof, while continuously withdrawing partially solidified metal as ingot from the opposite end opening of the mold, the improvement comprising:

means defining an annular flow passage which is circumposed about the cavity in the body of the mold to carry liquid coolant, and which opens into the ambient atmosphere of the mold adjacent the aforesaid opposite end opening thereof so as to direct the liquid coolant at the surface of the ingot as it emerges from the mold to extract heat from the same, means for introducing liquid coolant into the annular flow passage, means defining an annular gas distribution chamber which is disposed about the flow passage in the body of the mold, means for opening the chamber to the passage including an annular slot disposed upstream from the discharge opening of the passage at the periphery of the coolant flow therein, means for charging a body of pressurized gas into the annular distribution chamber, means for releasing the body of gas into the passage through the slot when the chamber is open to the passage, and means in the slot for subdividing the body of gas into a multiplicity of gas jets as the gas discharges through the slot, and for entraining the gas in the flow of coolant as a mass of bubbles that tend to remain discrete and undissolved in the flow as it discharges through the opening of the passage and impinges on the emerging body of metal.

25. The apparatus according to claim 24 wherein the means for subdividing the body of gas into gas jets include means in the slot forming a multiplicity of orifices through which the gas is constrained to flow as it discharges into the coolant flow passage from the gas distribution chamber.

26. The apparatus according to claim 25 wherein the orifice forming means take the form of a perforated strip in the slot.

27. The apparatus according to claim 25 wherein a perforated plastic membrane is interposed in the slot between the gas distribution chamber and the coolant flow passage.

28. The apparatus according to claim 25 wherein a perforated or crenulated metallic band is interposed in the slot between the gas distribution chamber and the coolant flow passage.

29. The apparatus according to claim 24 wherein that portion of the passage downstream from the slot is substantially rectilinear.

30. The apparatus according to claim 24 wherein that portion of the passage downstream from the slot is substantially curvilinear.

31. The apparatus according to claim 24 wherein that portion of the passage downstream from the slot is reentrant.

32. The apparatus according to claim 24 wherein there is a spur at the periphery of the passage which is collinear with that portion of the passage downstream from the slot, and wherein the gas release means are operative to release the body of gas into the spur.

33. The apparatus according to claim 24 further comprising an annular retention chamber circumposed about the axis of the cavity in the body of the mold, and wherein the coolant introduction means are operative to introduce the coolant into the passage through the annular retention chamber to cool the mold.

34. The apparatus according to claim 24 wherein the retention chamber is disposed at the level of the cavity.

35. The apparatus according to claim 24 wherein the retention chamber is disposed at a level corresponding to that at which the coolant impinges on the emerging ingot.

36. The apparatus according to claim 24 wherein there are means for forming an annulus of fluid in the cavity about the body of metal, which tends to flow relatively away from the one end opening of the same toward the level at which the liquid coolant impinges on the emerging ingot.

37. The apparatus according to claim 24 wherein the gas charging means include gas supply means, and valve means which are operable to prevent backflow into the gas supply means from the coolant flow passage.

38. The apparatus according to claim 24 wherein the mold takes the form of assembled parts, and the gas distribution chamber takes the form of a groove in the face of one part which is opposed to the face of another part when the parts are assembled.

39. The apparatus according to claim 38 wherein the coolant flow passage is defined by the aforesaid faces of the respective parts, and there is a strip disposed in the groove which is perforated to subdivide the body of gas into a multiplicity of jets when the gas is discharged through the mouth of the groove.

40. The apparatus according to claim 38 wherein the coolant flow passage is defined by the aforesaid faces of the respective parts, and there is a strip of one part disposed in the slot on the face thereof, which is perforated or crenulated to subdivide the body of gas into a multiplicity of jets when the gas is discharged through the strip.

* * * * *

UNITED STATES PATENT AND TRADEMARK OFFICE

CERTIFICATE OF CORRECTION

PATENT NO. : 4,693,298

DATED : September 15, 1987

INVENTOR(S) : Frank E. Wagstaff

It is certified that error appears in the above-identified patent and that said Letters Patent are hereby corrected as shown below:

Claim 1, line 49 of Column 13, before "a gas," insert --charging--.

Signed and Sealed this

First Day of March, 1988

*Attest:*

*Attesting Officer*

DONALD J. QUIGG

*Commissioner of Patents and Trademarks*